US012454963B2

(12) United States Patent
Yang et al.

(10) Patent No.: US 12,454,963 B2
(45) Date of Patent: Oct. 28, 2025

(54) CENTRIFUGAL FAN AND METHOD FOR MANUFACTURING THE SAME

(71) Applicant: LG ELECTRONICS INC., Seoul (KR)

(72) Inventors: Seungdeok Yang, Seoul (KR); Bonchang Hwang, Seoul (KR); Woojoo Choi, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/611,824

(22) Filed: Mar. 21, 2024

(65) Prior Publication Data

US 2025/0035128 A1 Jan. 30, 2025

(30) Foreign Application Priority Data

Jul. 21, 2023 (KR) ..... 10-2023-0095239

(51) Int. Cl.

| | |
|---|---|
| ***F04D 29/42*** | (2006.01) |
| ***F04D 17/16*** | (2006.01) |
| ***F04D 29/44*** | (2006.01) |
| ***F04D 29/62*** | (2006.01) |

(52) U.S. Cl.
CPC ..... *F04D 29/4226* (2013.01); *F04D 17/16* (2013.01); *F04D 29/444* (2013.01); *F04D 29/624* (2013.01)

(58) Field of Classification Search
None
See application file for complete search history.

(56) References Cited

U.S. PATENT DOCUMENTS 9,234,524 B2 * 1/2016 Shoji ..... F04D 29/30

FOREIGN PATENT DOCUMENTS

| | | |
|---|---|---|
| KR | 10-1625061 | 5/2016 |
| KR | 10-1645178 | 8/2016 |
| KR | 10-1677030 | 11/2016 |

* cited by examiner

*Primary Examiner* — Danielle M. Christensen
(74) *Attorney, Agent, or Firm* — KED & ASSOCIATES, LLP

(57) ABSTRACT

The present disclosure relates to a centrifugal fan and a method for manufacturing the same. The centrifugal fan can easily implement a three-dimensional blade by including a main plate, a blade, and a shroud that injection-molded as one body, thereby reducing the weight of the centrifugal fan and improving the operating efficiency. In addition, since assembly processes such as fastening or welding are unnecessary when manufacturing the blade, the defect rate of the blade can be reduced and the fluidity performance can be prevented from deteriorating due to traces of welded areas.

16 Claims, 18 Drawing Sheets

CENTRIFUGAL FAN AND METHOD FOR MANUFACTURING THE SAME

CROSS-REFERENCE TO RELATED APPLICATIONS

The present application claims priority under 35 U.S.C. 119 and 35 U.S.C. 365 to Korean Patent Application No. 10-2003-0095239 filed in Korea on Jul. 21, 2023, which is hereby incorporated by reference in its entirety.

BACKGROUND

The present disclosure relates to a centrifugal fan and a method for manufacturing the same.

DESCRIPTION OF RELATED ART

A centrifugal fan is a fan that accelerates air introduced in an axial direction through a shroud and discharges the accelerated air in a radial direction through gaps between blades. The performance of the centrifugal fan is affected by various shape factors as well as friction loss and impact loss. For example, the speed of the centrifugal fan, the shape of the blades, the angle or number, and the shape of the shroud are representative examples of factors that affect the performance of the centrifugal fan.

In particular, the shape of the blade is important because it can improve performance without significantly changing the overall size or specifications of the centrifugal fan. Recently, research has been actively conducted to obtain desired performance by attempting to variously change the shape of the blade.

A conventional blade has been formed of a steel material to implement a three-dimensional shape and improve strength. Since steel is not easy to process, a blade has been manufactured by individually manufacturing a plurality of parts constituting the blade and assembling the manufactured parts.

When the blade is manufactured using steel, there has been a problem in that the weight of the fan became heavy and operating efficiency was reduced. Due to limitations in processing steel, it has been difficult to effectively implement the desired three-dimensional shape and the manufacturing process for assembly has been complicated.

SUMMARY

An embodiment of the present disclosure provides to a blade capable of injection molding so as to easily implement the three-dimensional shape of the blade.

An embodiment of the present disclosure provides a centrifugal fan in which a main plate, a blade, and a shroud that constitute the centrifugal fan are manufactured at the same time by injection molding, thereby reducing the weight of the fan and improving the operating efficiency.

An embodiment of the present disclosure provides a centrifugal fan that improves the performance of the fan by providing a blade that is elongated from an opening where a hub is mounted to an edge of a main plate through injection molding.

An embodiment of the present disclosure provides a centrifugal fan in which injection molding of a blade is facilitated by forming a line connecting the leading edge of the blade to the center of the fan such that the length of the line increases from a main plate to a shroud.

An embodiment of the present disclosure provides a centrifugal fan in which injection molding of a blade is facilitated by improving the curvature of the blade such that the negative pressure surface of the blade is fully visible when the blade is viewed from the suction side of the fan.

An embodiment of the present disclosure provides a centrifugal fan in which the positive pressure performance of the fan is improved by forming a diffuser area capable of expanding air discharge on the outer circumference surfaces of the main plate and shroud.

An embodiment of the present disclosure provides a centrifugal fan capable of improving the change in curvature at the leading edge and trailing edge of the blade, thereby increasing the flow velocity in the positive pressure surface and improving the static pressure performance.

A centrifugal fan according to an embodiment of the present disclosure may easily implement a three-dimensional blade by including a main plate, a blade, and a shroud that injection-molded as one body, thereby reducing the weight of the centrifugal fan and improving the operating efficiency.

In addition, since assembly processes such as fastening or welding are unnecessary when manufacturing the blade, the defect rate of the blade may be reduced and the fluidity performance may be prevented from deteriorating due to traces of welded areas.

The centrifugal fan according to an embodiment of the present disclosure may include a blade having a leading edge, and the leading edge may be formed such that the distance from the center of the fan to the leading edge increases in the direction from the main plate to the shroud. Such a configuration has an advantage of enabling integrated injection of the blade through separation of molds.

When a plurality of lines are defined in a direction from the main plate to the shroud with respect to a line connecting the center of the fan to the leading edge, the angle between the plurality of lines and an arbitrary extension line may be formed to decrease.

The arbitrary extension line may be defined as an imaginary line connecting the center of the fan to a point on the outer circumference surface of the main plate.

The angle may be an acute angle.

The angle between the plurality of lines and the arbitrary extension line may decrease linearly.

The blade may include a positive pressure surface (Pr1) that faces the direction from which air blows with respect to the rotation direction of the blade, and a negative pressure surface (Pr2) that forms a surface opposite to the positive pressure surface.

The positive pressure surface (Pr1) may define a surface facing the outside of the fan, and the negative pressure surface (Pr2) may define a surface facing the inside of the fan.

When the fan is viewed in a direction from the suction side of the shroud to the main plate, the entire negative pressure surface of the blade may be visible.

The entire negative pressure surface of the blade may be arranged to face upward in the axial direction.

The leading edge of the blade may include a first end portion connected to the main plate, and the radial front end of the first end portion may be arranged to contact the outer circumferential surface of the hub connection portion.

The blade may include a trailing edge having a side end portion through which air is discharged based on the air flow, that is, an end opposite to the leading edge, and the trailing edge may be located further radially outward than the outer circumference of the blade connection portion of the main plate.

In this manner, since the blade is elongated in the radial direction from the leading edge to the trailing edge, the fluidity of air sucked in the axial direction and discharged in the radial direction may be improved and the positive pressure may be increased.

The outer circumferential surface of the main plate may include a first diffuser capable of expanding the flow path of air discharged in the radial direction, thereby improving the static pressure performance of the fan.

The outer circumferential surface of the shroud may include a second diffuser capable of expanding the flow path of air discharged in the radial direction, thereby improving the static pressure performance of the fan.

The blade may include a leading edge extending with a first curvature in the axial direction from the main plate to the shroud, and a trailing edge extending with a second curvature in the axial direction. With this configuration, the flow rate on the positive pressure surface of the blade may increase and the static pressure performance may be improved.

In particular, based on the same height of the blade with respect to the axial extension line, the angle formed between the leading edge and the extension line may be less than the angle formed between the trailing edge and the extension line.

The blade may include a first end portion connected to the main plate and a second end portion connected to the shroud. The length of the cord at the second end portion is greater than the length of the cord at the first end portion, thereby improving the fluidity performance of air sucked in the axial direction and discharged in the radial direction.

According to an aspect of the present disclosure, a centrifugal fan may include a main plate having an opening for mounting a motor, a shroud spaced apart from the main plate and having an inlet port for sucking air in an axial direction, and a plurality of blades connected between the main plate and the shroud and arranged in a circumferential direction of the opening so as to discharge air sucked through the inlet port in a radial direction.

Each of the plurality of blades may include a positive pressure surface through which air blows, a negative pressure surface opposite to the positive pressure surface, a leading edge defining a front end of the air discharged in the radial direction, and a trailing edge defining a rear end of the air.

The main plate, the shroud, and the plurality of blades may be integrally formed as one body through injection such that the positive pressure surface, the negative pressure surface, the leading edge and the trailing edge form a curved surface to implement a three-dimensional shape of the blade.

The leading edge may be formed such that a distance from a center of the main plate to the leading edge increases in a direction from the main plate towards the shroud.

When a center line (fc) extending radially from the center of the main plate and a plurality of points of the leading edge are defined, the plurality of points being arranged in the direction from the main plate to the shroud among the leading edge, a center angle formed by the center line and an extension line connecting the plurality of points and the center of the main plate becomes smaller as a distance from the extension line to the shroud decreases.

The leading edge may include a first portion connected to the main plate, and a second portion, a third portion and a fourth portion sequentially extending from the first portion towards the shroud.

When a center line extending radially from the center of the main plate and first to fourth extension lines connecting the center of the main plate to the first to fourth portions are defined, a center angle formed between the center line and the second extension line may be less than an angle formed between the center line and the first extension line.

A center angle formed between the center line and the third extension line may be less than an angle formed between the center line and the second extension line.

When a plurality of points are defined in the leading edge in the direction from the main plate to the shroud, a length of the extension line connecting the plurality of points from the center of the main plate may increase as a distance from the extension line towards the shroud decreases.

When first to fourth extension lines connecting the center of the main plate to the first to fourth portions are defined, a length of the second extension line may be longer than a length of the first extension line and a length of the third extension line may be longer than the length of the second extension line.

The negative pressure surface of the blade may be arranged such that an entire negative pressure surface faces the inlet port of the shroud.

The blade may include a first end portion connected to the main plate and a second end portion connected to the shroud, and the first end portion is connected to an outer circumference of the protrusion surrounding the opening of the main plate.

The first end portion may include a protruding connection portion connected to the outer circumference of the protrusion. When a tangent to the outer circumference of the protrusion at the protruding connection portion is defined, the tangent and the first end portion may form a predetermined angle.

The first end portions of the plurality of blades may extend from the protrusion at the predetermined angle.

A length of a first cord from the leading edge to the trailing edge at the first end portion may be shorter than a length of a second cord from the leading edge to the trailing edge at the second end portion.

The main plate may include a blade connection portion provided outside the opening and to which the blade is connected, an extension portion bent from the blade connection portion, and a boundary portion forming a boundary between the blade connection portion and the expansion portion.

A portion of the second end portion that meets the trailing edge may be located radially outward than the boundary portion.

A first angle formed between an extension line of the first cord and the boundary portion may be greater than a second angle formed between the second cord and the boundary portion.

When an axial extension line passing through the protruding connection portion is defined, the leading edge may be formed such that a distance from the extension line to the leading edge increases in the direction from the main plate towards the shroud.

A bending size of the trailing edge with respect to an extension line in a vertical direction may be greater than a bending size of the leading edge with respect to the extension line in the vertical direction.

When a first axial extension line in contact with a first part where the leading edge meets the second end portion and a second axial extension line in contact with a second part where the trailing edge meets the second end portion are defined, an angle formed between the second extension line and the trailing edge at the second part may be greater than an angle formed between the first extension line and the leading edge at the first part.

The second end portion of the blade may include a first part formed convexly upward in an axial direction to connect the leading edge to the shroud, a distance between the first part and the main plate having a first height.

The second end portion may further include a second part formed concavely downward in an axial direction to connect the trailing edge to the shroud, a distance between the second part and the main plate having a second height, and the first height may be greater than the second height.

The blade may further include a bent portion formed in the middle between the leading edge and the trailing edge and in which an extension direction of the blade is bent.

The blade may have a shape that is folded by the bent portion such that a direction of a first air flow from the leading edge to the bent portion is opposite to a direction of a second air flow from the bent portion to the trailing edge.

The main plate, the shroud, and the blade may be injected by a first mold having a portion implementing a shape of the main plate, a second mold having a portion implementing a shape of the shroud, and a plurality of third molds having portions implementing a shape of the blade.

According to another aspect of the present disclosure, there may be proposed a method for manufacturing a centrifugal fan including a main plate having an opening for mounting a motor, a shroud spaced apart from the main plate and having an inlet port for sucking air in an axial direction, and a plurality of blades connected between the main plate and the shroud and arranged in a circumferential direction of the opening so as to discharge air sucked through the inlet port in a radial direction.

The method may include preparing a plurality of molds for implementing three-dimensional shapes of the main plate, the shroud, and the plurality of blades, integrally forming the main plate, the shroud, and the plurality of blades into one body through injection molding, and separating the plurality of molds.

A leading edge may be formed such that a distance from a center of the main plate to the leading edge increases in a direction from the main plate towards the shroud so as to allow separation of the plurality of molds implementing shapes of the plurality of blades.

DETAILED DESCRIPTION OF THE EMBODIMENTS

Figure 1:
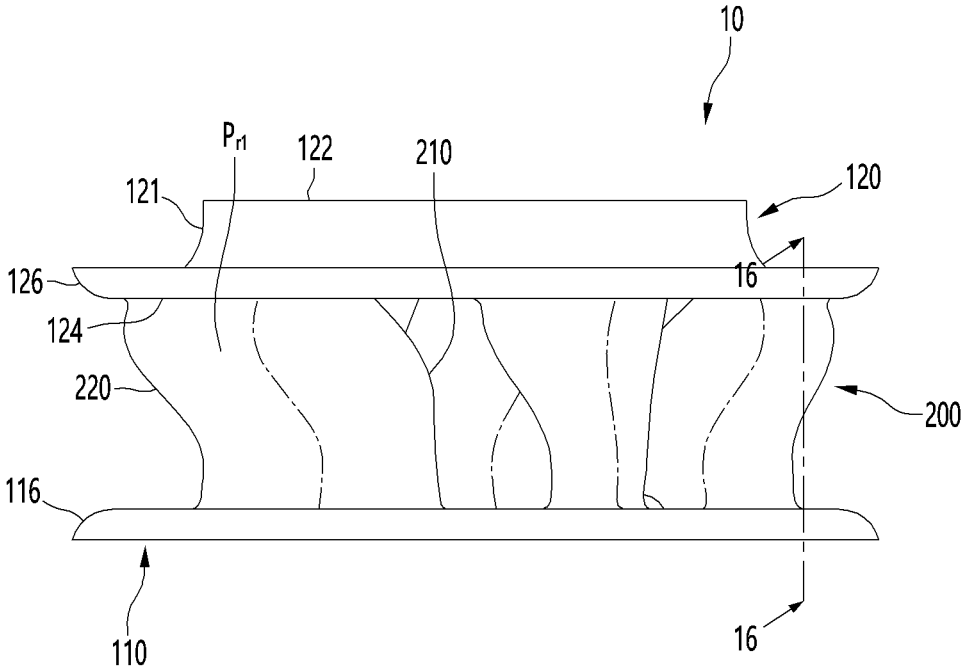
FIG. 1 is a front view of a centrifugal fan according to an embodiment of the present disclosure.

Hereinafter, some embodiments of the present disclosure will be described in detail with reference to exemplary drawings. In assigning reference numerals to elements of the drawings, it should be noted that the same elements are denoted by the same reference numerals as much as possible even though the same elements are illustrated in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one element from another, and the essence, order, or sequence of the elements is not limited by the terms. When one component is described as being "connected", "coupled", or "linked" to another component, the component may be directly connected or coupled to the other component, but it should be understood that another component may be "connected", "coupled" or "linked" between components.

Figure 2:
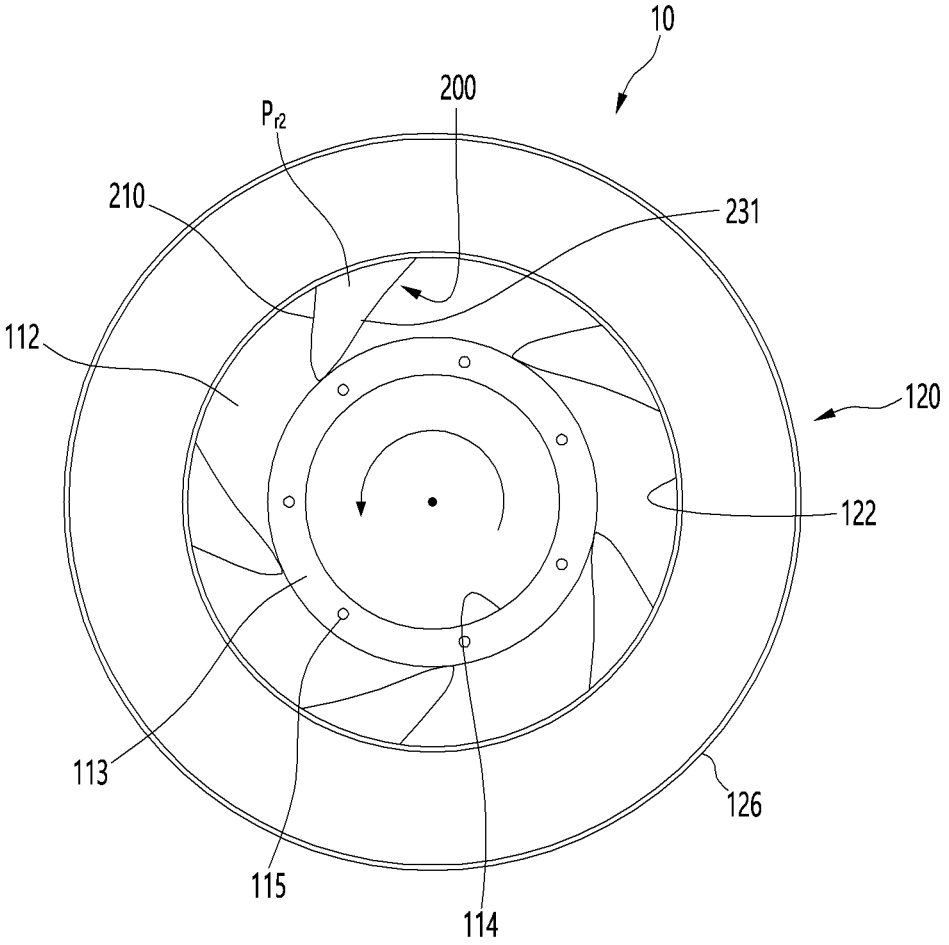
FIG. 2 is a plan view of the centrifugal fan according to an embodiment of the present disclosure.
Figure 3:
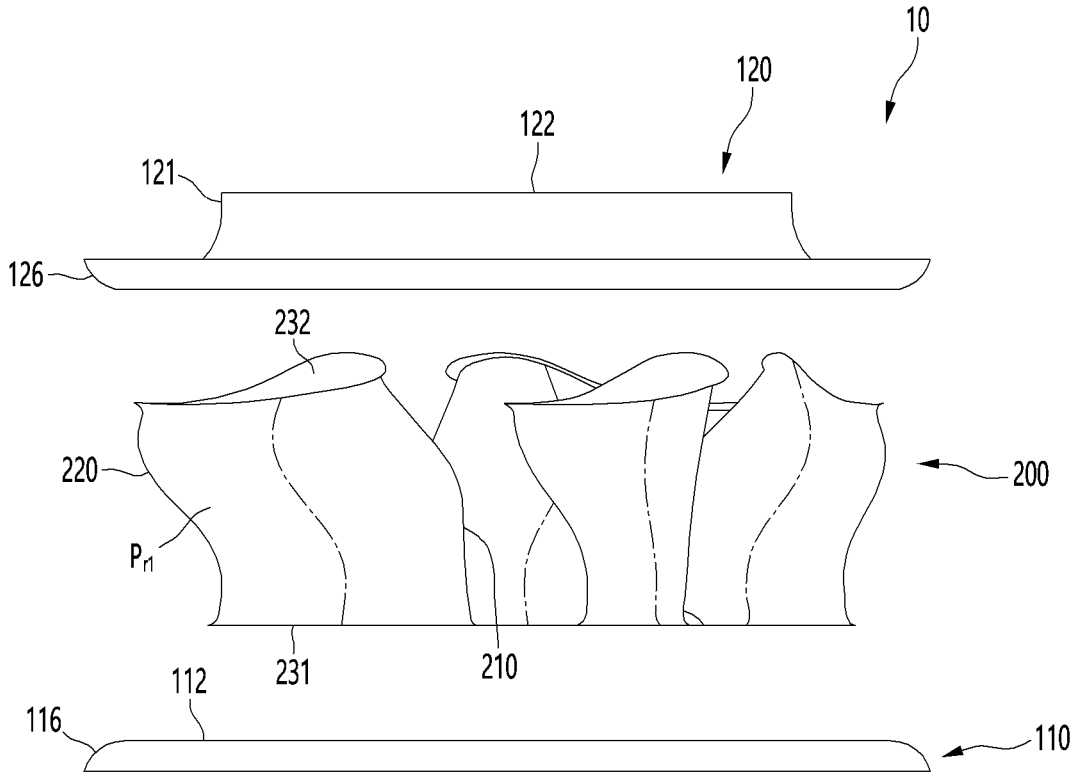
FIG. 3 is an exploded perspective view of the centrifugal fan according to an embodiment of the present disclosure.
Figure 4:
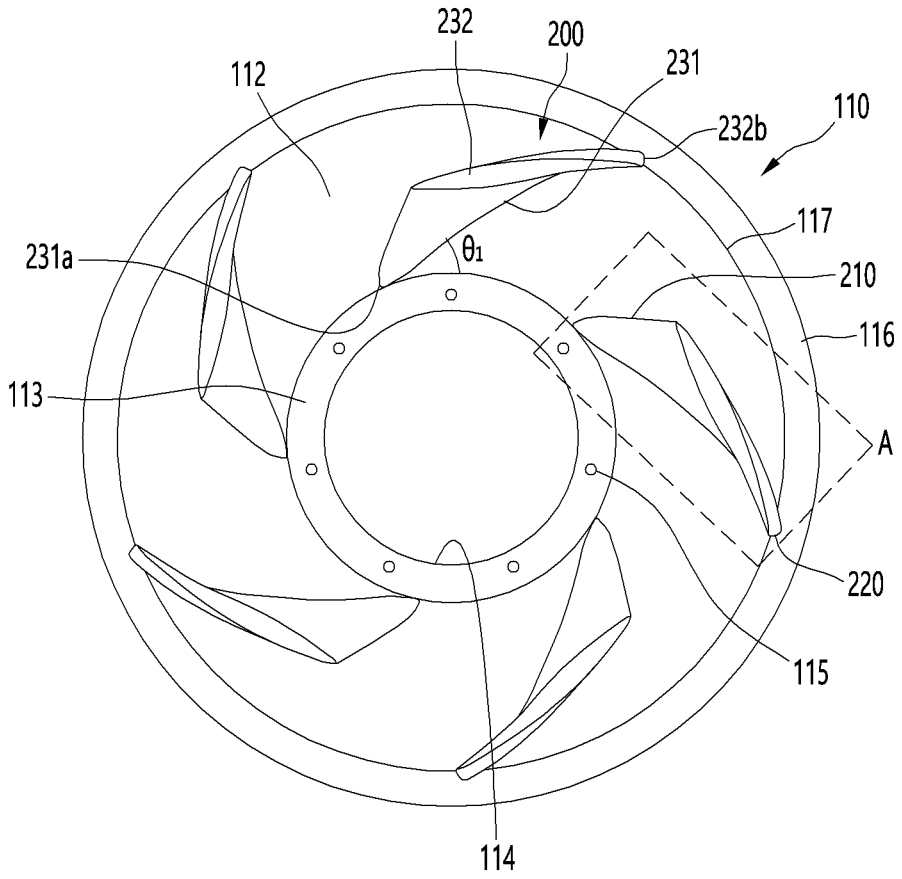
FIG. 4 is a plan view of the centrifugal fan, from which a shroud is removed, according to an embodiment of the present disclosure.

FIG. 1 is a front view of a centrifugal fan according to an embodiment of the present disclosure, FIG. 2 is a plan view of the centrifugal fan according to an embodiment of the present disclosure, FIG. 3 is an exploded perspective view of the centrifugal fan according to an embodiment of the present disclosure, and FIG. 4 is a plan view of the centrifugal fan, from which a shroud is removed, according to an embodiment of the present disclosure.

Referring to FIGS. 1 to 4, a centrifugal fan 10 according to an embodiment of the present disclosure may be configured to suck air in the axial direction and discharge air in the radial direction.

The centrifugal fan 10 may be used in, for example, an air conditioner. In particular, air may be naturally introduced into the centrifugal fan 10 and discharged from the centrifugal fan 10. The centrifugal fan 10 may be installed without a duct.

For example, the centrifugal fan 10 may constitute a plug-type fan module applied to an air conditioner that is installed outdoor to exchange heat with air introduced from the room and supply the heat-exchanged air back to the room. Accordingly, the centrifugal fan 10 may be called a "plug fan".

The centrifugal fan 10 may include a main plate 110, a shroud 120, and a blade 200. The main plate 110, the shroud 120, and the blade 200 may be formed integrally without separate assembly.

For example, the main plate 110, the shroud 120, and the blade 200 may be integrally injection-molded using a mold. The three-dimensional blade 200 may be implemented through the injection molding.

Since a separate process for assembling the blade 200 and the main plate 100 and assembling the blade 200 and the shroud 120 is not required, the fan may be easily manufactured and the defect rate may be reduced. Additionally, since fastening members or welding portions for assembly may be removed, deterioration of fluidity performance due to the assembly areas may be prevented.

The main plate 110 may be coupled to a fan motor (not shown) and may have, for example, a disk shape. In detail, the main plate 110 may include a first blade connection portion 112 connected to the blade 200, and a protrusion 113 formed at the center of the first blade connection portion 112 and defining an area where a hub (not shown) is mounted.

The first blade connection portion 112 may include a flat surface such that the lower end of the blade 200 is connected thereto. The protrusion 113 may protrude upward from the first blade connection portion 112 in the axial direction.

The protrusion 113 may protrude in an approximately circular shape. A mounting opening 114 may be formed in the protrusion 113 such that the hub is mounted thereon. Due to the mounting opening 114, the protrusion 113 may have a ring shape.

The protrusion 113 may include a fastening hole 115 into which the hub is fastened. A fastening member may be coupled to the fastening hole 115 to couple the hub to the protrusion 113. A plurality of fastening holes 115 may be provided and arranged along the circumference of the mounting opening 114.

The shaft of the motor may be coupled to the hub, and the main plate 110 may receive the rotational force of the motor through the hub. For example, based on FIG. 2, the main plate 110 may rotate counterclockwise.

The main plate 110 may include a first expansion portion 116 provided on the outer circumference of the first blade connection portion 112 to expand the flow path of air discharged in the radial direction. The first extension 116 may be configured to be curved or bent upward from the outer circumference of the first blade connection portion 112.

The main plate 110 may further include a boundary portion 117 forming an interface between the first blade connection portion 112 and the first extension portion 116. The boundary portion 117 may form the outer circumference of the first blade connection portion 112 and may have, for example, a circular shape.

The shroud 120 may be spaced upward apart from the main plate 110 in the axial direction. The shroud 120 may include a shroud body 121 having an inlet port 122. The inlet port 122 may be opened in the center of the shroud body 121.

The shroud body 121 may extend downward from the upper end portion where the inlet port 122 is formed and then extend roundly outward in the radial direction. Due to this configuration, the shroud body 121 may have an eaves shape extending from the inlet port 122.

The shroud 120 may include a second expansion portion 126 provided on the outer circumference of the shroud body 121 to expand the flow path of air discharged in the radial direction. The second expansion portion 126 may be configured to be curved or bent upward from the outer circumference of the shroud body 121.

Due to the first and second expansion portions 116 and 126, the flow path of air discharged in the radial direction of the fan 10 may be expanded, thereby improving the performance of the fan.

The shroud 120 may include a second blade connection portion 124 formed on the bottom of the shroud body 121 and connected to the blade 200.

The centrifugal fan 10 may include the blade 200 disposed in a space between the main plate 110 and the shroud 120. A plurality of blades 200 may be provided and arranged in the circumferential direction of the centrifugal fan 10.

The plurality of blades 200 may be configured to have a height in a direction in which the shaft of the motor extends.

The blade 200 may include a leading edge 210 defining a front end portion through which discharged air passes and a trailing edge 220 defining a rear end portion when the air sucked in the axial direction of the centrifugal fan 10 is discharged in the radial direction.

The leading edge 210 may form the radially innermost side of the blade 200, and the trailing edge 220 may form the radially outermost side of the blade 200.

The leading edge 210 may include a surface curved in the longitudinal direction (vertical direction) to guide air sucked into the blade. The trailing edge 220 may include a surface curved in the longitudinal direction (vertical direction) to guide air discharged from the blade.

A radial straight line connecting the leading edge 210 to the trailing edge 220 of the blade 200 may be defined as a cord, and the cord may have a predetermined length.

The blade 200 may include a first end portion 231 connected to the main plate 110 and a second end portion 232 connected to the shroud 120. The first end portion 231 may define the lower end portion of the blade 200, and the second end portion 232 may define the upper end portion of the blade 200.

The first the end portion 231 may include a flat surface so as to be connected to the main plate 110. The second end portion 232 may include a curved surface so as to be connected to the shroud 120.

The blade 200 may be configured to have a vertical height from the first end portion 231 to the second end portion 232.

The first end portion 231 may include a protruding connection portion **231*a* defining a front end of the first end portion 231 and connected to the leading edge 210**.

The protruding connection portion **231*a* may be connected to the protrusion 113. In detail, the outer circumference of the protrusion 113 may have a circular shape, and the protruding connection portion 231*a* may be arranged to be connected to the outer circumference of the protrusion 113**.

According to this configuration, the leading edge 210 is disposed adjacent to the protrusion 113 and the hub, and thus, air sucked in the axial direction may directly act on the leading edge 210. The blade 200 may be formed to be relatively long and connected to the first blade connection portion 112 of the main plate 110.

The first end portion 231 may form a predetermined angle 81 with respect to the outer circumference of the protrusion 113.

In detail, when a tangent to the outer circumference of the protrusion 113 in the protruding connection portion 113*a* is defined, the tangent and the first end portion 231 may form the predetermined angle 81. The first end portion 231 may be understood as an outer surface of an end portion in a direction from the leading edge 210 to the trailing edge 220.

For the plurality of blades 200, the predetermined angles 61 may have the same value. Accordingly, the air sucked in the axial direction of the fan 10 may be uniformly distributed and flow in the radial direction through the space between the plurality of blades 200.

A rear end (second part) 232*b* of the second end portion 232 that meets the trailing edge 220 may be disposed further radially outward than the boundary portion 117 of the main plate 110. Accordingly, the air discharged from the blade 200 through the trailing edge 220 may be discharged from the fan 10 through the expanded flow path in the first expansion portion 116.

The directions are defined.

The direction in which the shaft of the motor extends is defined as the axial direction or the vertical direction. The upward direction of the centrifugal fan 10 may refer to the direction in which the protrusion 113 protrudes from the main plate 110 and the direction in which air is sucked. The downward direction of the centrifugal fan 10 may refer to the direction in which air is sucked in the axial direction.

Accordingly, the first end portion 231 of the blade 200 may form the lower end portion of the blade 200, and the second end portion 232 may form the upper end portion of the blade 200.

The blade 200 may include a positive pressure surface Pr1 that faces the direction from which air blows based on the rotation direction of the blade 200, and a negative pressure surface Pr2 that forms a surface opposite to the positive pressure surface. The positive pressure surface Pr1 may be understood as a surface that is pressurized by air, and the negative pressure surface Pr2 may be understood as a surface that receives an external pulling force.

Based on FIG. 2, the centrifugal fan 10 may rotate counterclockwise. Based on the counterclockwise direction, the outer surface of the blade 200 may form the positive pressure surface Pr1, and the inner surface of the blade 200 may form the negative pressure surface Pr2.

The positive pressure surface Pr1 and the negative pressure surface Pr2 may each include a curved surface to guide the flow of air acting on the blade 200.

Among the plurality of blades 200, the flow path of air discharged in the radial direction may be formed between the negative pressure surface Pr2 of one blade 200 and the positive pressure surface Pr1 of another adjacent blade 200. The flow path of the air may include a plurality of flow paths corresponding to the number of blades 234.

The blade 200 may have a three-dimensional shape due to the leading edge 210 and the trailing edge 220, the first end portion 231 and the second end portion 232, the positive pressure surface Pr1 and the negative pressure surface Pr2.

In this way, the blade 200 may be configured to have a three-dimensional shape including surfaces curved in the axial and vertical directions. Since the blade 200 is integrally formed with the main plate 110 and the shroud 120 through injection molding, a three-dimensional blade shape may be easily implemented.

Since the blade 200 may be coupled to the main plate 110 and the shroud 120 without a separate assembly process, the manufacturing process may be simplified and the defect rate may be reduced.

Figure 5:
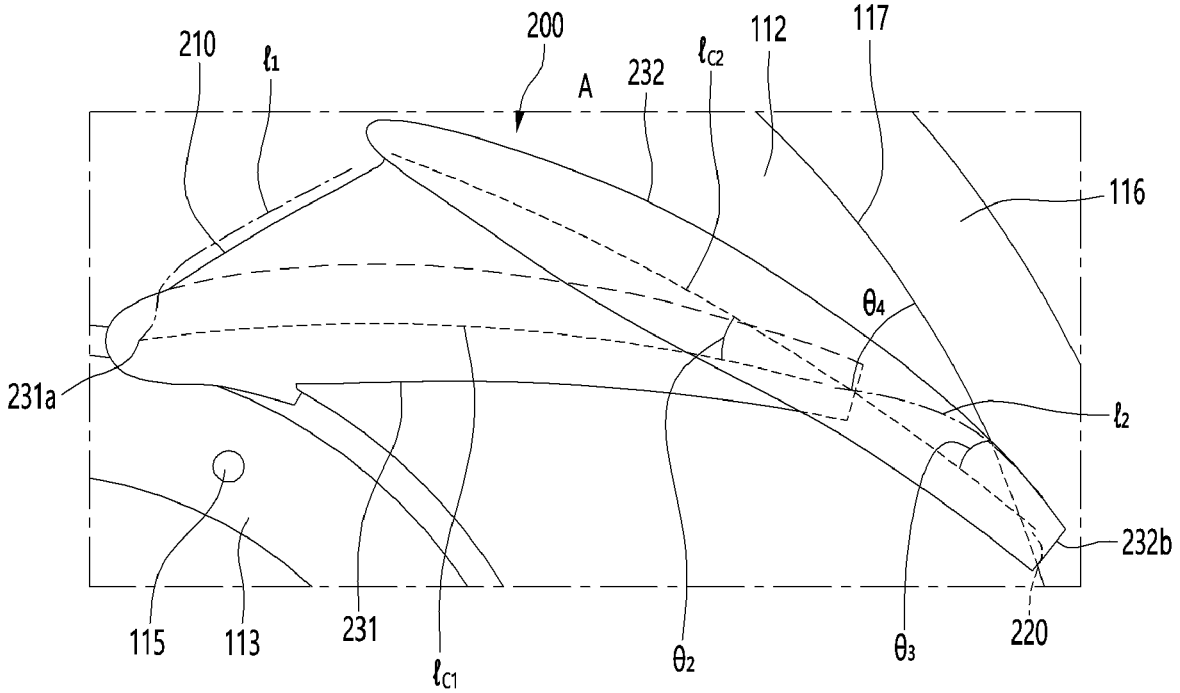
FIG. 5 is a diagram showing a configuration of a blade in the centrifugal fan according to an embodiment of the present disclosure.
Figure 6:
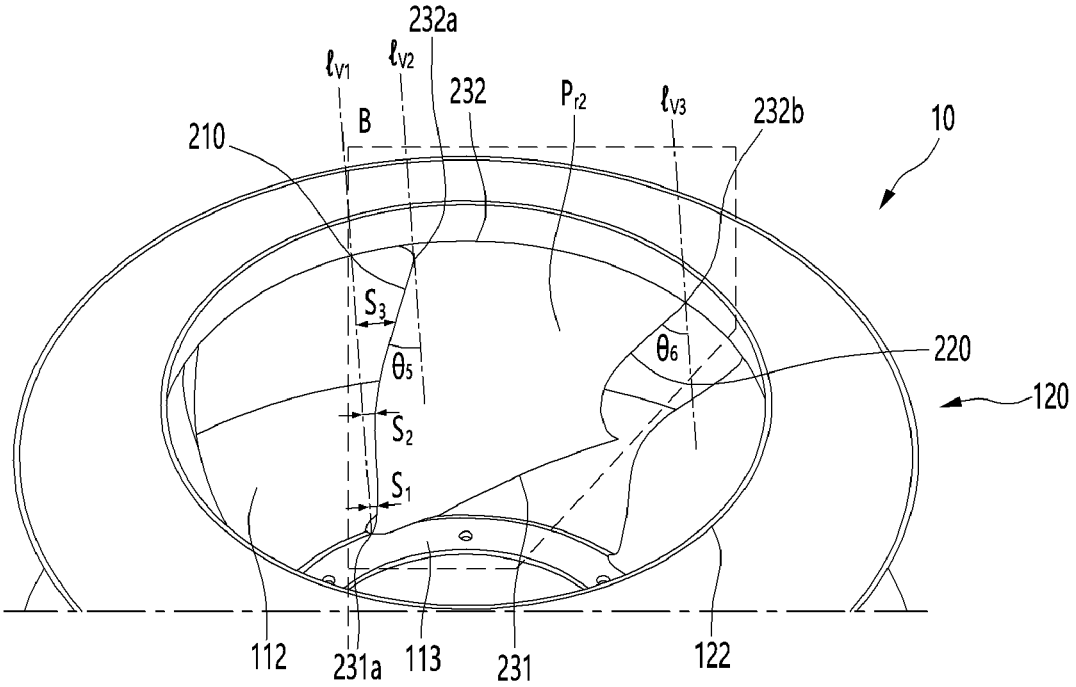
FIG. 6 is a perspective view showing a partial configuration of the centrifugal fan according to an embodiment of the present disclosure.
Figure 7:
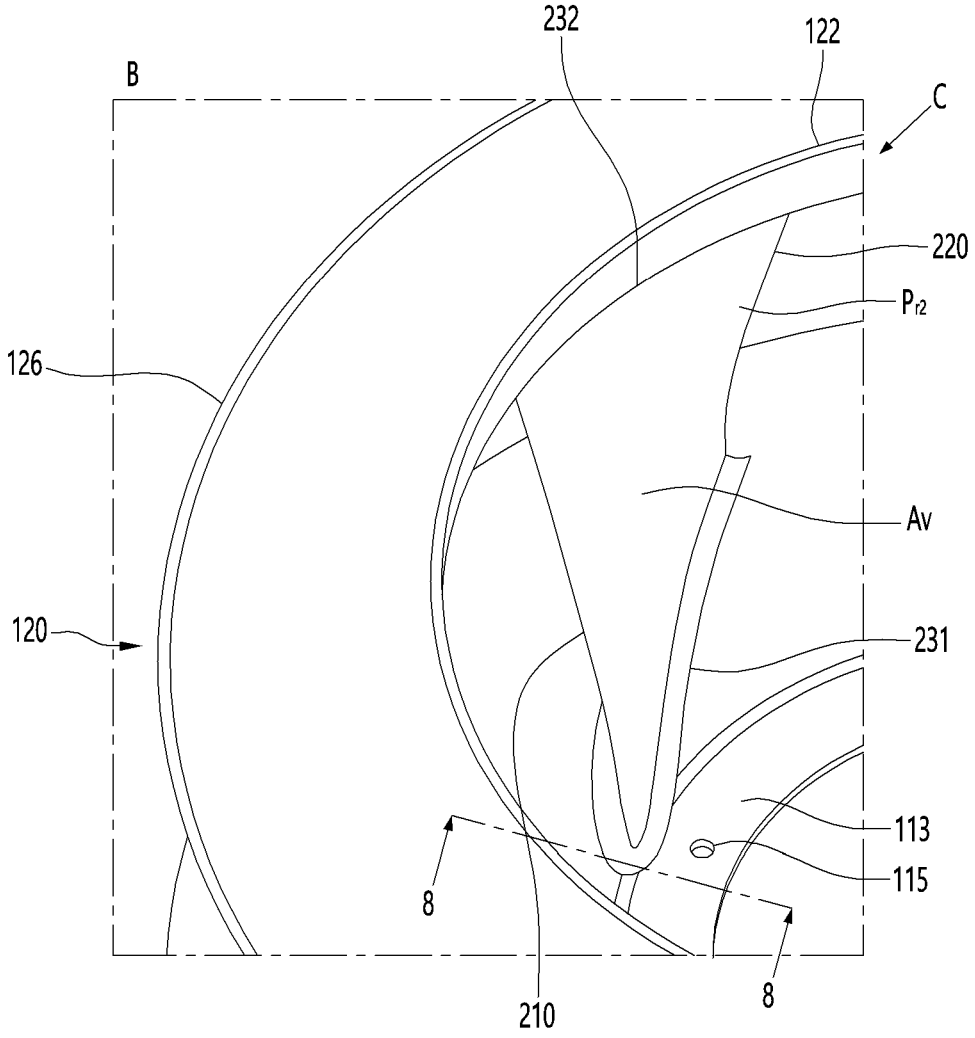
FIG. 7 is an enlarged view of a portion "B" of FIG. 6.
Figure 8:
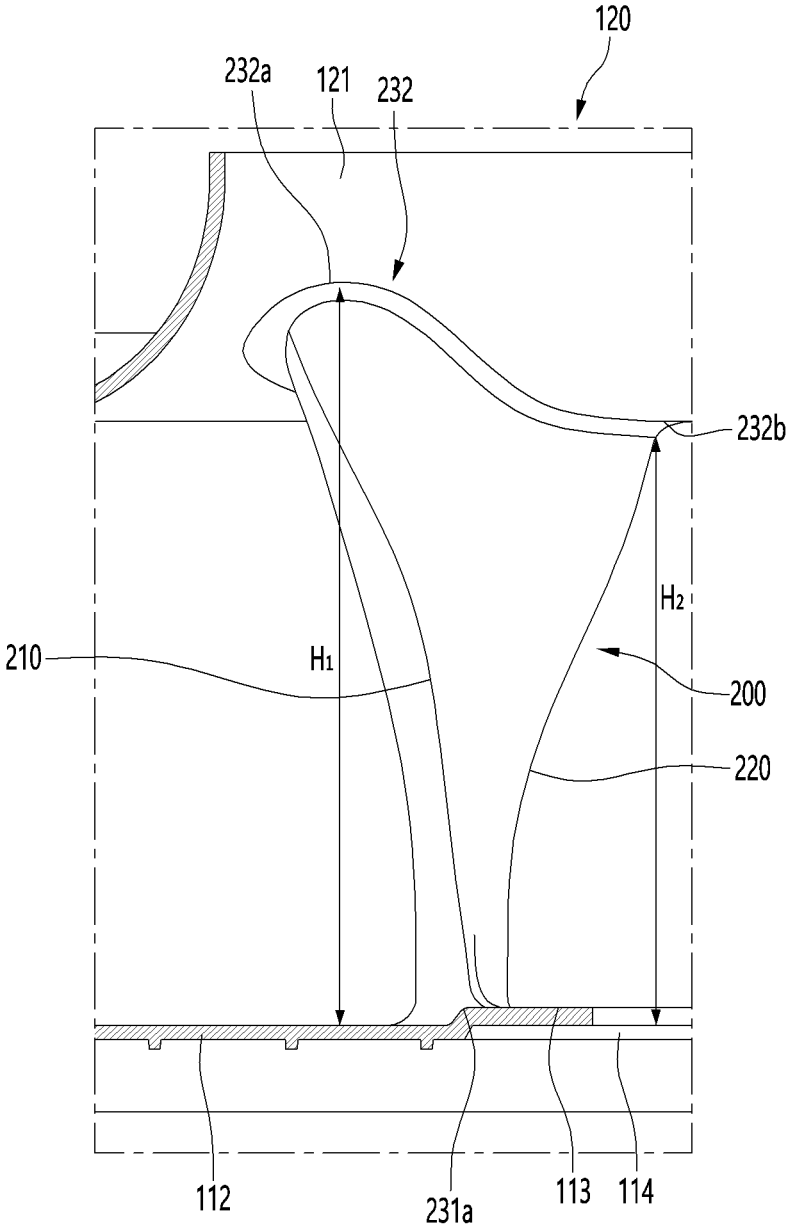
FIG. 8 is a cross-sectional view taken along line 8-8 of FIG. 7.
Figure 9:
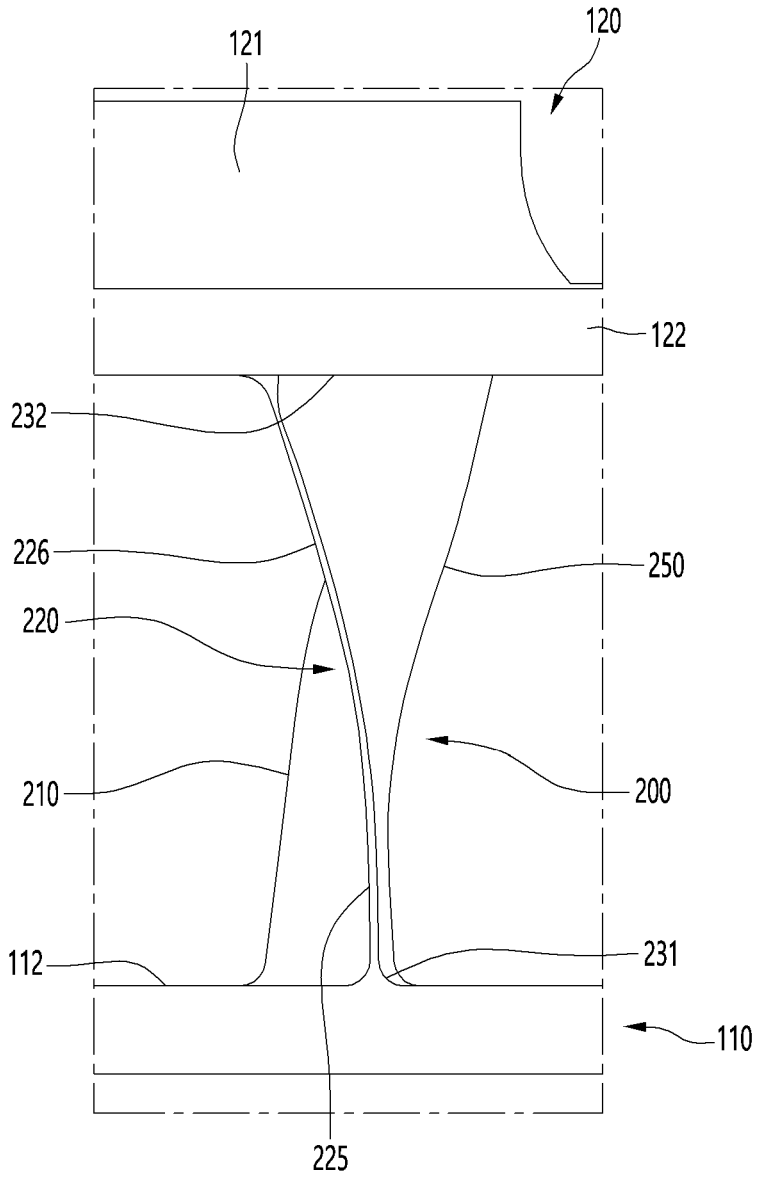
FIG. 9 is a view when viewed from a direction "C" of FIG. 7.

FIG. 5 is a diagram showing the configuration of the blade in the centrifugal fan according to an embodiment of the present disclosure, FIG. 6 is a perspective view showing a partial configuration of the centrifugal fan according to an embodiment of the present disclosure, FIG. 7 is an enlarged view of a portion "B" of FIG. 6, FIG. 8 is a cross-sectional view taken along line 8-8 of FIG. 7, and FIG. 9 is a view when viewed from a direction "C" of FIG. 7.

Referring to FIGS. 5 to 9, the blade 200 according to an embodiment of the present disclosure may be configured such that the first end portion 231 and the second end portion 232 extend in different directions.

The angle formed by the first end portion 231 with respect to the outer circumference of the protrusion 113 may be greater than the angle formed by the second end portion 232 with respect to the outer circumference of the protrusion 113.

In detail, referring to FIG. 5, the first end portion 231 may be formed at the protruding connection portion 231*a* to form the first predetermined angle θ1 with respect to the outer circumference of the protrusion 113. On the other hand, the second end portion 232 may extend in a direction substantially parallel to the outer circumference of the protrusion 113. That is, the angle formed by the second end portion 232 with respect to the outer circumference of the protrusion 113 may be less than the first predetermined angle 81.

The first end portion 231 connected to the main plate 110 may meet the outer circumference of the protrusion 113 at the leading edge 210 and may be formed to extend towards the trailing edge 220.

The thickness of the first end portion 231 on the leading edge side may be greater than the thickness of the first end portion 231 on the trailing edge side. The thickness may be understood as the distance from the positive pressure surface of the blade 200 in the direction towards the negative pressure surface. According to this configuration, the operating efficiency of the fan 10 may be improved because a force in the rotation direction of the fan 10 is applied to the blade 200.

On the first end portion side, a first cord ℓc1 connecting from the leading edge 210 to the trailing edge 220 may be defined.

On the second end portion side, a second cord ℓc2 connecting from the leading edge 210 to the trailing edge 220 may be defined.

The length of the second cord ℓc2 may be longer than the length of the first cord ℓc1.

According to this configuration, since the length of the second end portion 232 connected to the shroud 120 of the blade 200 is longer than the length of the first end portion 231, air sucked downward in the axial direction may be too concentrated towards the first end portion 231, thereby preventing the flow of the air, and the discharge in the radial direction from the second end 232 may be guided.

The second cord ℓc2 and the first cord ℓc1 may be form a second predetermined angle θ2.

A portion (rear end) 232*b* of the second end portion 232 that meets the trailing edge 220 may be located further radially outside the boundary portion 117 of the main plate 110. The angle between the second cord ℓc2 and the boundary portion 117 may form a third predetermined angle θ3.

The angle between the extension line of the first cord ℓc1 and the boundary portion 117 may form a fourth predetermined angle θ4, and the fourth predetermined angle θ4 may be greater than the third predetermined angle θ3.

According to this configuration, it is possible to easily guide the air flow passing through the blade 200 by increasing the length of the blade 200 within the main plate 110 with a limited volume.

In FIG. 5, the leading edge 210 connecting the front end of the first end portion 231 to the front end of the second end 232 may extend along a first imaginary line ℓ1, and the trailing edge 220 connecting the rear end of the first end portion 231 to the rear end of the second end portion 232 may extend along a second imaginary line ℓ2.

Referring to FIG. 6, the blade 200 according to an embodiment of the present disclosure may include a leading edge 210 and a trailing edge 220 that extend curvedly in the axial direction.

The leading edge 210 may be connected to the main plate 110 at the protruding connection portion 231*a*, may extend upward in the axial direction, and may be connected to the shroud 120.

When the first extension line ℓv1 in the vertical direction in contact with the protruding connection portion 231*a* is defined, the leading edge 210 may be formed to be gradually farther upward away from the first extension line ℓv1.

In detail, when the lower, middle and upper portions of the leading edge 210 are defined, the distance S3 spaced apart from the first extension line ℓv1 at the upper portion of the leading edge 210 may be greater than the distance S2 spaced apart from the first extension line ℓv1 at the middle portion of the leading edge 210.

The distance S3 separated from the first extension line ℓv1 at the middle of the leading edge 210 may be greater than the distance S1 from the first extension line ℓv1 at the lower portion of the leading edge 210.

When the second extension line ℓv2 in the vertical direction in contact with the first part 232*a* where the leading edge 210 and the second end 232 meet each other is defined, the second extension line ℓv2 and the leading edge 210 may form a predetermined angle θ5 at the first part 232*a*. The first part 232*a* may be understood as the front end of the second end portion 232.

When the third extension line ℓv3 in the vertical direction in contact with the second part 232*b* where the trailing edge 220 and the second end 232 meet each other is defined, the third extension line ℓv3 and the trailing edge 220 may form a predetermined angle θ6 at the second part 232*b*. The second part 232*b* may be understood as the rear end of the second end portion 232.

The predetermined angle θ6 may be greater than the predetermined angle 85.

That is, the bending size of the trailing edge 220 with respect to the vertical extension line may be greater than the bending size of the leading edge 210 with respect to the vertical direction line.

Referring to FIG. 8, a first height H1 at which the leading edge 210 extends from the main plate 110 to the shroud 120 may be greater than a second height H2 at which the trailing edge 220 extends from the main plate 110 to the shroud 120.

To this end, the first part 232*a* that meets the leading edge 210 at the second end portion 232 of the blade 200 connected to the shroud 120 may have an upwardly convex shape and may be connected to the shroud 120.

On the other hand, the second part 232*b* that meets the trailing edge 220 at the second end portion 232 of the blade 200 connected to the shroud 120 may have a downward concave shape and may be connected to the shroud 120.

That is, the first direction in which the first part 232*a* is rounded on the bottom of the shroud 120 may be a direction opposite to the second direction in which the second part 232*b* is rounded on the bottom of the shroud 120.

According to this configuration, since the blade height on the leading edge side is greater than the blade height on the trailing edge side, the size of the flow path defined by the blade 200 may be greater on the leading edge side than on the trailing edge side.

The air sucked into the centrifugal fan 10 may pass through the blade 200 while passing through a wide flow path on the leading edge side, and the flow velocity may be increased while passing through a relatively small flow path towards the trailing edge 220. The "flow path" may be understood as a space having one side defined by the blade 200.

The blade 200 may be formed on the bottom of the shroud 120 so as to be rounded in the first and second directions, thereby implementing a three-dimensional shape. This may be easily implemented by injection-molding the main plate 100, the shroud 120, and the blade 200 as one piece.

Referring to FIG. 9, the trailing edge 220 according to an embodiment of the present disclosure may include a first part 225 connected to the main plate 110 and a second part 226 extending upward from the first part 225 and connected to the shroud 120.

The first part 225 may extend linearly directly upward from the main plate 110.

The second part 226 may be bent or curved from the first part 225 and may be connected to the bottom surface of the shroud 120. The second part 226 may extend in an inclined direction with respect to the shroud 120.

The middle portion of the blade 200 between the leading edge 210 and the trailing edge 220 may include a bent portion 250 in which the extension direction of the blade 200 is bent.

Due to the bent portion 250, the blade 200 may have a folded shape when viewed from the trailing edge side.

Therefore, based on the air flow from the leading edge 210 towards the trailing edge 220, the direction of the first air flow from the leading edge 210 to the bent portion 250 may be opposite to the direction of the second air flow from the bent portion 250 to the trailing edge 220. With this configuration, the positive pressure performance of the centrifugal fan may be improved.

Figure 10:
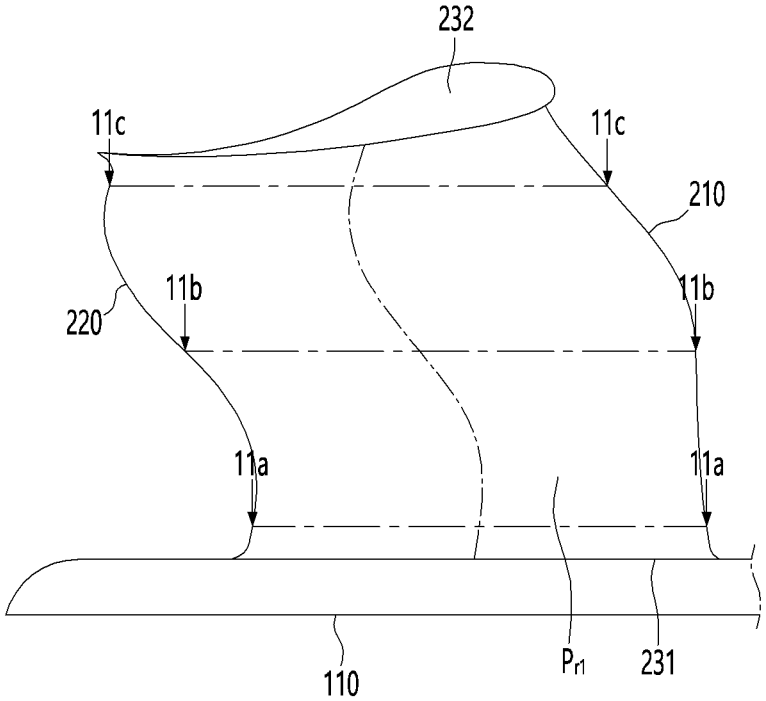
FIG. 10 is a view showing the configuration of the blade according to an embodiment of the present disclosure.
Figure 11A:
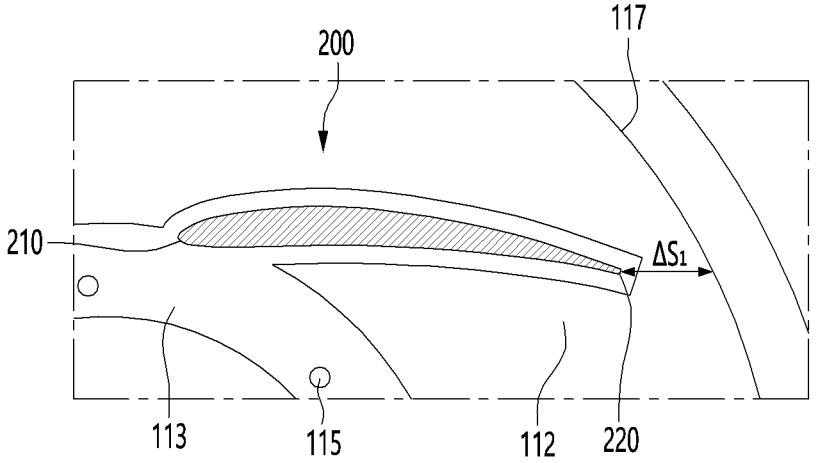
FIG. 11A is a cross-sectional view taken along line 11*a*-11*a* of FIG. 10.
Figure 11B:
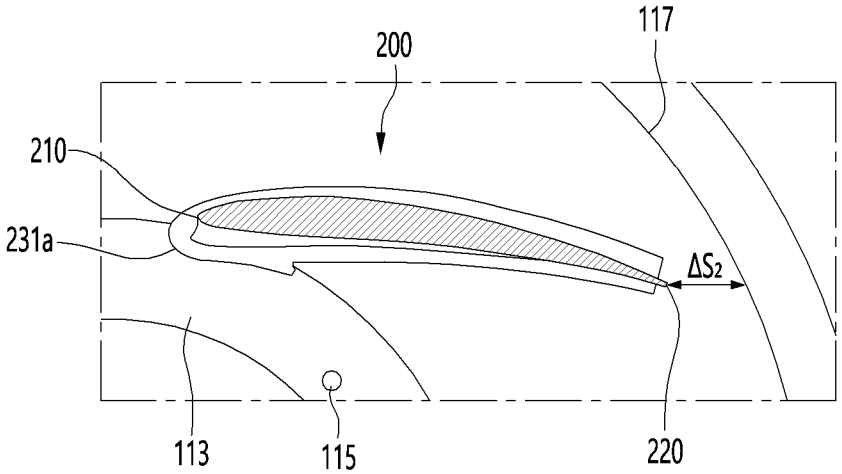
FIG. 11B is a cross-sectional view taken along line 11*b*-11*b* of FIG. 10.
Figure 11C:
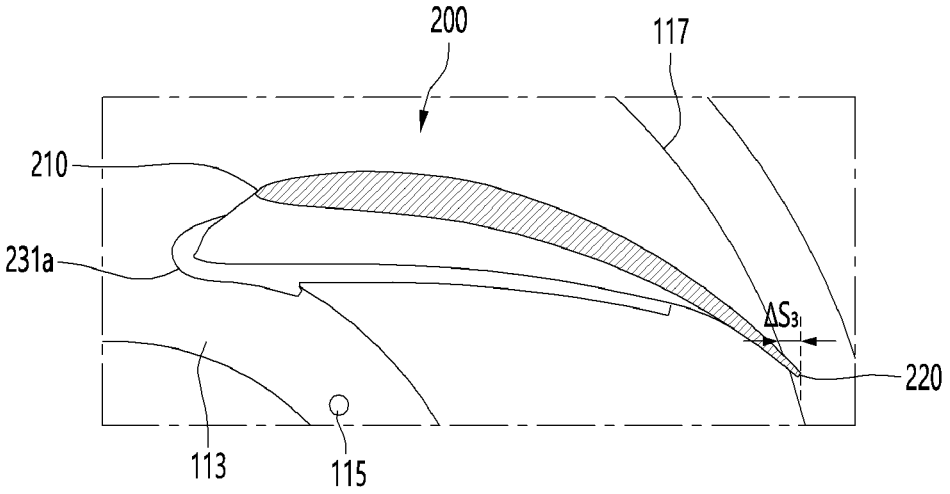
FIG. 11C is a cross-sectional view taken along line 11*c*-11*c* of FIG. 10.

FIG. 10 is a view showing the configuration of the blade according to an embodiment of the present disclosure, FIG. 11A is a cross-sectional view taken along line 11*a*-11*a* of FIG. 10, FIG. 11B is a cross-sectional view taken along line 11*b*-11*b* of FIG. 10, and FIG. 11C is a cross-sectional view taken along line 11*c*-11*c* of FIG. 10.

Referring to FIGS. 10 to 11C, the blade 200 according to an embodiment of the present disclosure may include a leading edge 210 and a trailing edge 220 that extend curvedly upward from the main plate 100.

The first end portion 231 having the lower end portion of the leading edge 210 may be connected to the outer circumference of the protrusion 113, and the leading edge 210 may be bent upward and away from the vertical tangent line that contacts the connecting point.

In detail, the lower end portion of the blade 200 may form a protruding connection portion 231*a* connected to the outer circumference of the protrusion 113 (FIG. 11A), and as it moves upward, the leading edge 210 may be located at a point farther away from the outer circumference of the protrusion 113 in the radial direction (FIGS. 11B and 11C).

That is, the leading edge 210 formed in the middle of the blade 200 in the vertical direction may be located radially outward from the protruding connection portion 231*a* (FIG. 11B).

The leading edge 210 formed in the upper portion of the blade 200 in the vertical direction may be located radially outward from the leading edge 210 in the middle portion (FIG. 11C).

The trailing edge 220 may be formed such that the position at the upper portion of the blade 200 is radially outer than the position at the lower portion of the blade 200.

In detail, the trailing edge 220 at the lower portion of the blade 200 may be located at a position spaced apart from the boundary portion 117 of the main plate 110 by a first distance ΔS1 in the direction of the center of the main plate 110.

The trailing edge 220 may extend concavely inward in the radial direction of the main plate 110 from the lower portion of the blade 200 to a certain height at which an inflection portion 220*a* is formed, and may extend convexly outward in the radial direction from above the inflection portion 220*a*.

That is, based on the inflection portion 220*a*, the trailing edge 220 may include an edge lower portion extending concavely inward in the radial direction of the main plate 110, and an edge upper portion extending upward from the edge lower portion and convexly extending outward in the radial direction of the main plate 110.

The bending direction of the edge lower portion may be opposite to the bending direction of the edge upper portion. The curvature of the bending of the edge upper portion may be greater than the curvature of the edge lower portion.

The trailing edge portion of the upper side of the inflection portion 220*a*, that is, the middle portion of the trailing edge 220 may be spaced apart from the boundary portion 117 of the main plate 110 by a second distance ΔS2 in the direction towards the center of the plate 110. The second distance ΔS2 may be less than the first distance ΔS1.

The upper portion of the trailing edge 220 adjacent to the second end portion 232 of the blade 200 may be located at a position spaced apart from the boundary portion 117 of the main plate 110 by a third distance ΔS3.

That is, since the trailing edge 220 is formed in a radial position further outward at the upper end portion than at the lower end portion, air sucked from the inlet port 122 towards the main plate 110 may be prevented from concentrating on the lower portion of the blade 200, and air may be easily discharged from the upper end portion of the blade 200 in the radial direction along the trailing edge 220.

Figure 12:
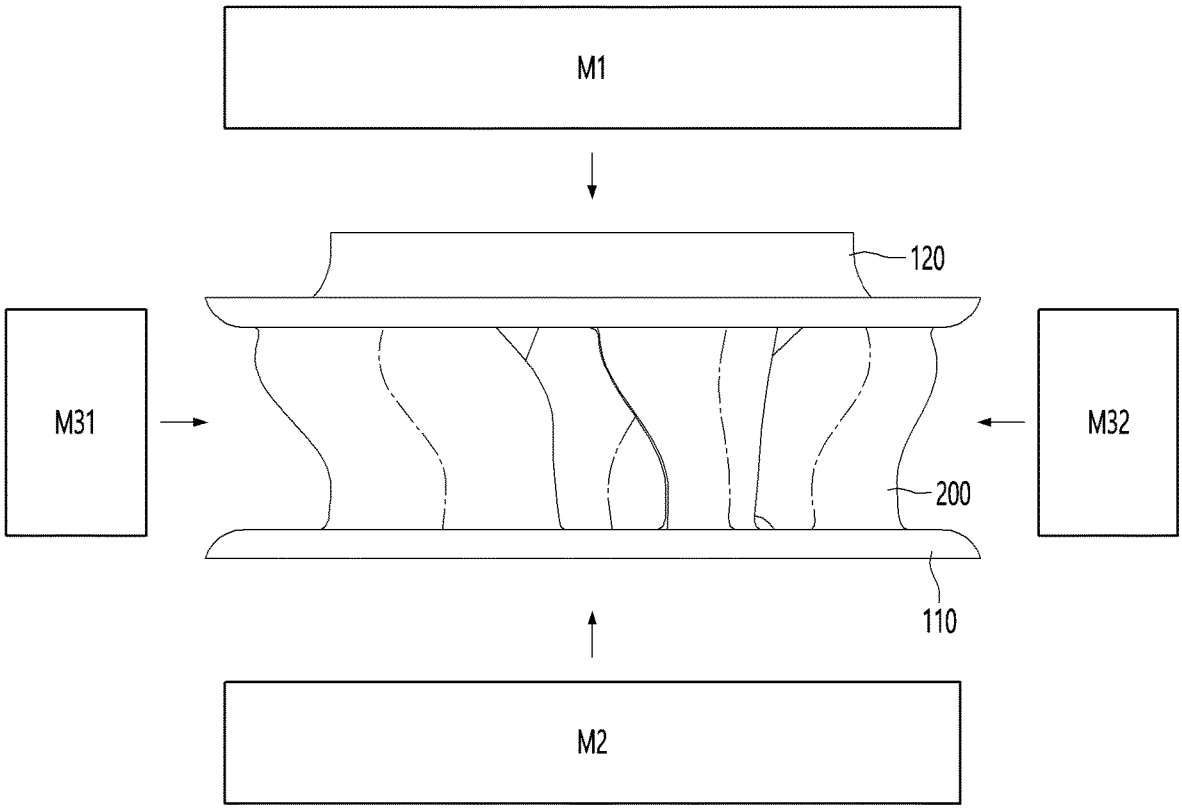
FIG. 12 is a schematic view showing a mold disposed for manufacturing the centrifugal fan according to an embodiment of the present disclosure.
Figure 13:
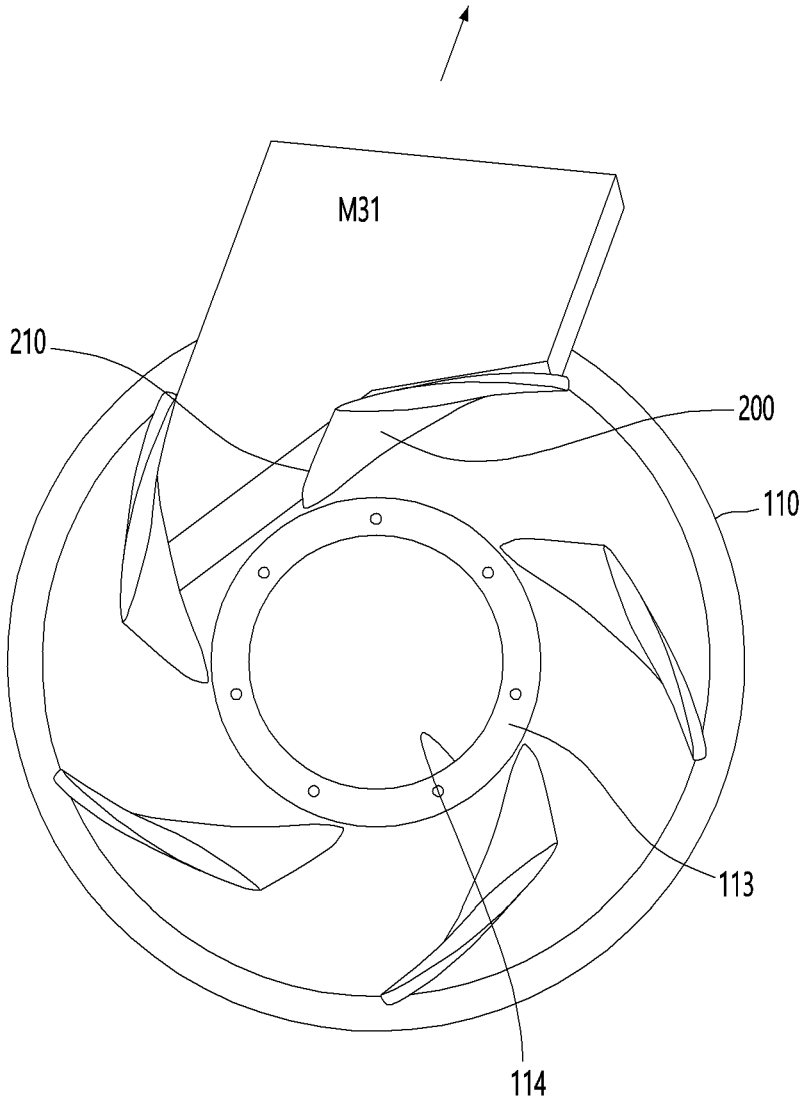
FIG. 13 is a schematic view showing a portion of a mold disposed for injection molding of the blade according to an embodiment of the present disclosure.

FIG. 12 is a schematic view showing a mold disposed for manufacturing the centrifugal fan according to an embodiment of the present disclosure, and FIG. 13 is a schematic view showing a portion of a mold disposed for injection molding of the blade according to an embodiment of the present disclosure.

Referring to FIGS. 12 and 13, the centrifugal fan 10 according to an embodiment of the present disclosure may be manufactured through injection molding.

In detail, a main plate 110, a shroud 120, and a blade 200 that constitute the centrifugal fan 10 may be formed of the same material, for example, resin.

The main plate 110, the shroud 120, and blade 200 may be integrally formed as one body through injection molding.

For the injection molding, a plurality of molds M1, M2, M31, and M32 may be used. The plurality of molds M1, M2, M31, and M32 may include a first mold M1 located on the upper side of the shroud 120 and a second mold M2 located on the lower side of the main plate 110.

The first mold M1 may include a portion for implementing the shape of the shroud 120, and the second mold M2 may include a portion for implementing the shape of the main plate 110.

The plurality of molds M1, M2, M31, and M32 may include a plurality of third molds M31 and M32 located on the sides of the plurality of blades 200. The plurality of third molds M31 and M32 may be understood as molds including portions for implementing the shapes of the plurality of blades 200.

The shape of the blade 200 may be implemented by putting the injection mold between two adjacent third molds. That is, the outer shape of the blade 200 may be implemented by combining the two adjacent third molds.

For convenience of explanation, it has been described that two third molds M31 and 32 are provided, but more third molds may be provided to correspond to the number of blades. For example, when five blades 200 are provided as shown in FIG. 4, five molds may be provided correspondingly.

Referring to FIG. 13, the third mold M31 may be located between two adjacent blades 200. The third mold M31 may be intervened between the positive pressure surface Pr1 of one blade 200 and the negative pressure surface Pr2 of the other blade 200, and may include a mold portion that can implement the three-dimensional shapes of the one blade 200 and the other blade 200.

As shown in FIG. 13, when five blades 200 are provided, five third molds may be provided and each mold may be disposed between two adjacent blades to perform injection molding.

After the injection molding of the blade 200 is completed, the third molds M31 and 32 may be separated in the radial direction. At this time, it is necessary to consider the shape of the blade 200 such that it does not interfere with the molded blade 200 when the third molds M31 and 32 are separated.

Figure 14A:
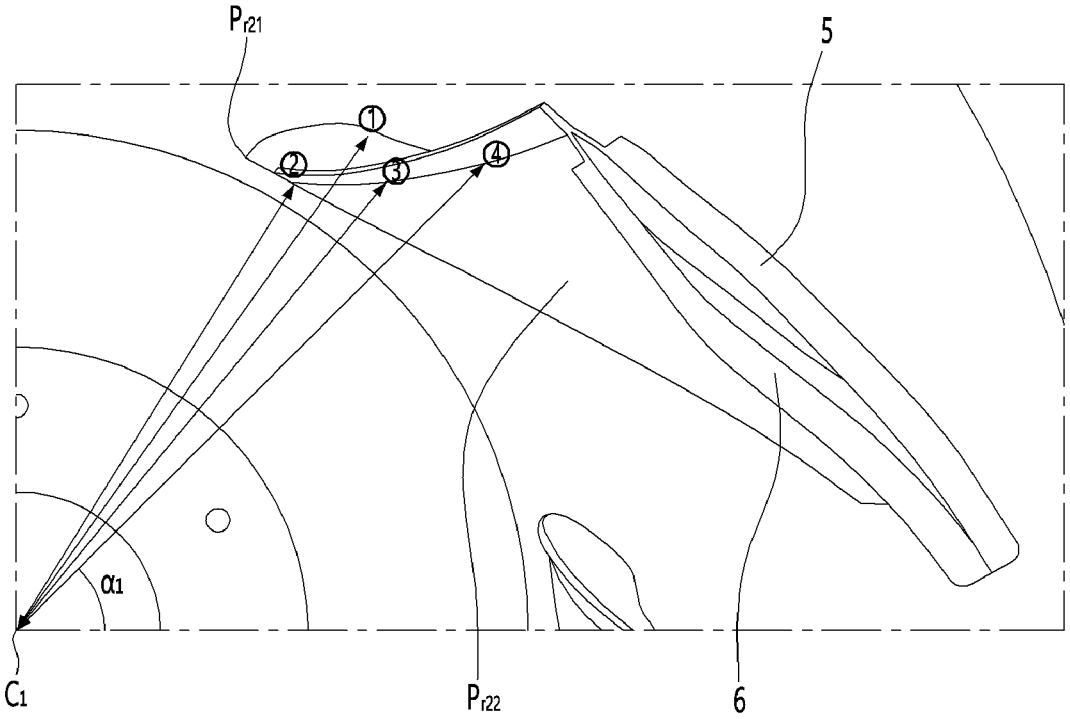
FIG. 14A is a partial top view of a centrifugal fan showing a configuration of a blade according to the related art.

FIG. 14A shows a configuration of a conventional blade. The conventional blade may be formed of a steel material. Since it is not easy to process the steel material, it may not be easy to implement the three-dimensional shape of the blade.

The blade may include a first forming portion 5 including a portion forming a positive pressure surface and a second forming portion 6 including a portion forming a negative pressure surface. The blade may include an empty space between the first forming portion 5 and the second forming portion 6.

The first forming portion 5 and the second forming portion 6 may be assembled using a predetermined fastening member or welding member. In the process of performing the assembly process using the fastening member or the welding member, blade defects may occur and fluid performance may be reduced due to traces of the fastening (welding) portion.

On the other hand, FIG. 14A is a view of the blade when viewed from the inlet port side of the shroud. The blade may include a lower portion connected to the main plate and an upper portion extending from the lower portion to the shroud, and the lower portion and the upper portion may have a bent shape by a bent portion therebetween.

The leading edge of the blade may include first to fourth portions ① to ④ in a direction from the lower portion connected to the main plate to the upper portion connected to the shroud.

In detail, the first negative pressure surface Pr21 formed at the lower portion of the blade with respect to the negative pressure surface Pr2 may include a first negative pressure surface Pr21 extending in the inner radial direction from the first portion ① of the leading edge connected to the main plate towards the center of the main plate, and a second negative pressure surface Pr22 extending upward from the first negative pressure surface Pr21 and extending in the outer radial direction of the main plate.

The second to fourth portions ② to ④ may be portions extending upward from the first portion of the leading edge, and the fourth portion ④ may be understood as a portion adjacent to the upper end portion of the blade connected to the shroud.

The bent portion may be located between the first negative pressure surface Pr21 and the second negative pressure surface Pr22.

When the centrifugal fan is viewed from the upper side towards the main plate, the first negative pressure surface Pr21 is not visible. In detail, the bent portion from the first portion ① connected to the main plate is not visible, and the second negative pressure surface Pr22 corresponding to the second to fourth portions ② to ④ is visible.

For this purpose, when the center line ℓc extending radially from the center C1 of the main plate is defined and the extension lines connecting from the center C1 to the first to fourth portions ① to ④ are defined, the angle (center angle) α1 formed between the center line ℓc and each extension line may be measured.

The angle formed between the center line ℓc and the first extension line connecting the first portion ① to the center C1 may be less than the angle formed between the center line ℓc and the second extension line connecting the second portion ② to the center C1. In addition, the length of the first extension line may be longer than the length of the second extension line.

The angle formed between the center line ℓc and the third extension line connecting the third portion ③ to the center C1 may be less than the angle formed between the center line ℓc and the second extension line connecting the second portion ② the center C1. The length of the third extension line may be longer than the length of the second extension line.

The angle formed between the center line ℓc and the fourth extension line connecting the fourth portion ④ to the center C1 may be less than the angle formed between the center line ℓc and the third extension line connecting the third portion ③ to the center C1. The length of the fourth extension line may be longer than the length of the third extension line.

That is, the center angle α1 may increase in the direction from the first portion ① to the second portion ②, while the length of the extension line may become shorter. The center angle α1 may decrease in the direction from the second portion ② to the fourth portion ④ while the length of the extension line may become longer.

When the blade is formed of a steel material and manufactured by assembling the forming portions 5 and 6, it may be possible to implement the shape of the blade including the first to fourth portions ① to ④.

However, when the shape of the blade is implemented through injection molding, a problem in which the mold and the blade interfere with each other due to the shapes of the first and second portions ① to ② may occur in the process of separating the mold in the outer radial direction. Therefore, such a shape is difficult to implement through injection molding.

Figure 14B:
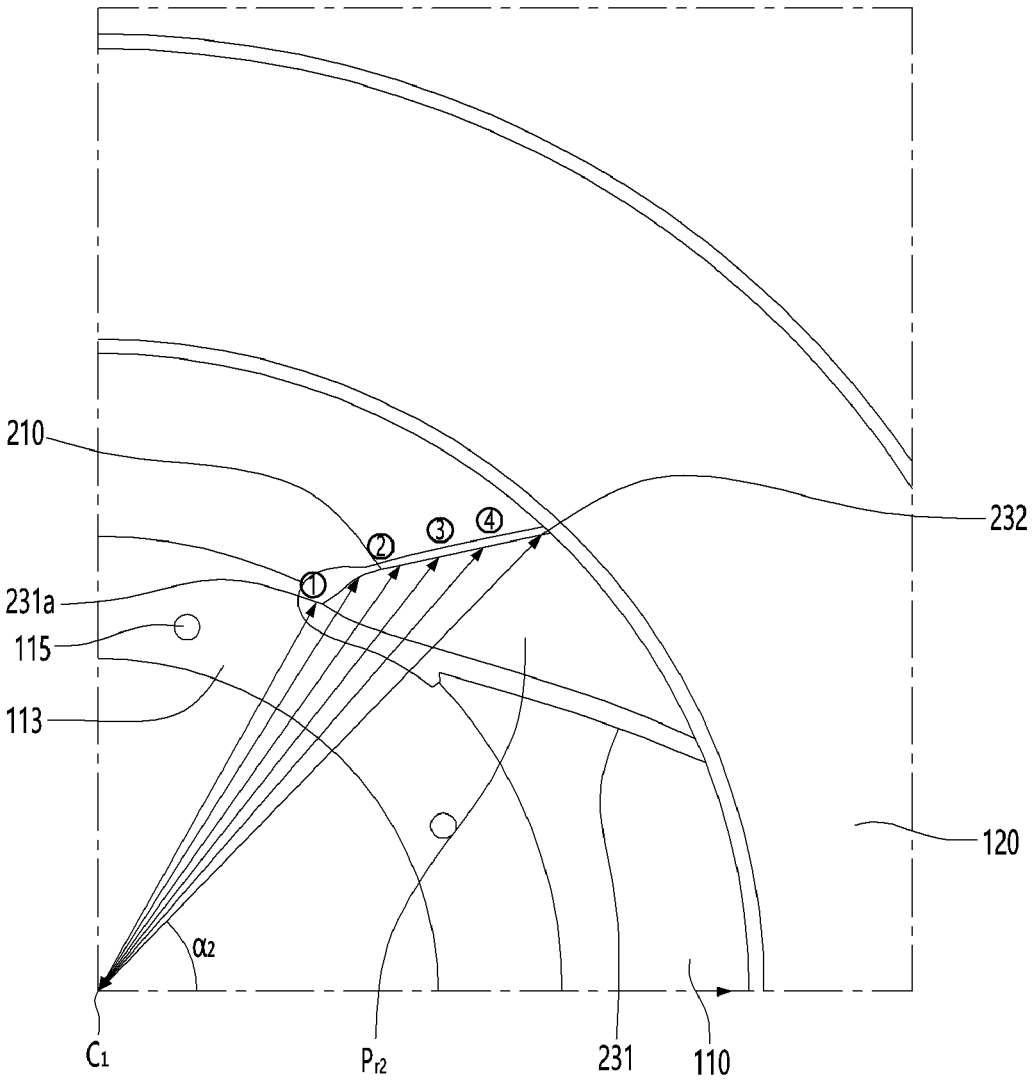
FIG. 14B is a partial top view of a centrifugal fan showing a configuration of a blade according to an embodiment of the present disclosure.

FIG. 14B shows the shape of the blade 200 according to an embodiment of the present disclosure. FIG. 14B is a view when the main plate 110 is viewed from the shroud side in which the inlet port 122 is formed, in the same manner as in FIG. 14A.

The leading edge 210 of the blade 2000 may include first to fourth portions ① to ④ in a direction from the lower portion connected to the main plate 110 to the upper portion connected to the shroud 120.

When the centrifugal fan 10 is viewed from the upper side towards the main plate, the entire negative pressure surface Pr2 of the blade 220 may be visible (see a viewing area Av in FIG. 7).

That is, the entire surface of the negative pressure surface Pr2 may be arranged to face upward of the centrifugal fan 10, that is, towards the inlet port 122.

For this purpose, when the center line ℓc extending radially from the center C1 of the main plate is defined and the extension lines connecting from the center C1 to the first to fourth portions ① to ④ are defined, the angle (center angle) α2 formed between the center line ℓc and each extension line may be measured.

The angle formed between the center line ℓc and the second extension line connecting the second portion ② to the center C1 may be less than the angle formed between the center line ℓc and the first extension line connecting the first portion ① to the center C1. The length of the second extension line may be longer than the length of the first extension line.

The angle formed between the center line ℓc and the third extension line connecting the third portion ③ to the center C1 may be less than the angle formed between the center line ℓc and the second extension line connecting the second portion ② to the center C1. The length of the third extension line may be longer than the length of the second extension line.

The angle formed between the center line ℓc and the fourth extension line connecting the fourth portion ④ to the center C1 may be less than the angle formed between the center line ℓc and the third extension line connecting the third portion ③ to the center C1. The length of the fourth extension line may be longer than the length of the third extension line.

The center angle α2 may decrease in the direction from the first portion ① to the fourth portion ④, while the length that extension line may become longer.

According to this configuration, after injection-molding the blade 200 using a mold, when the mold is separated in the outer radial direction, the mold and the blade do not interfere, thereby facilitating injection molding.

Figure 15:
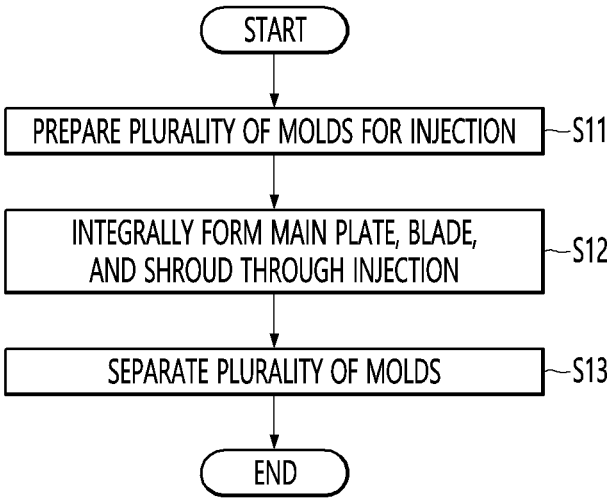
FIG. 15 is a flowchart showing a method for manufacturing a centrifugal fan according to an embodiment of the present disclosure.

FIG. 15 is a flowchart showing a method for manufacturing a centrifugal fan according to an embodiment of the present disclosure.

Referring to FIG. 15, the plurality of molds M1, M2, M31, and M32 for injection may be prepared such that the main plate 110, the shroud 120, and the blade 200, which constitute the centrifugal fan 10, may be integrally formed as one body (S11).

The main plate 110, the shroud 120, and the blade 200 may be integrally formed as one body by putting the resin for injection into the mold and completing the injection molding (S12).

The plurality of molds M1, M2, M31, and M32 may be separated. For example, the first mold M1 may be separated to the upper side of the shroud 120, and the second mold M2 may be separated to the lower side of the main plate 110. The plurality of third molds M31 and M32 may be separated by moving in the radial direction of the centrifugal fan 10 (S13).

In this manner, the main plate, the blade, and the shroud that constitute the centrifugal fan may be manufactured at the same time by injection molding, thereby reducing the weight of the fan and improving the operating efficiency.

Figure 16:
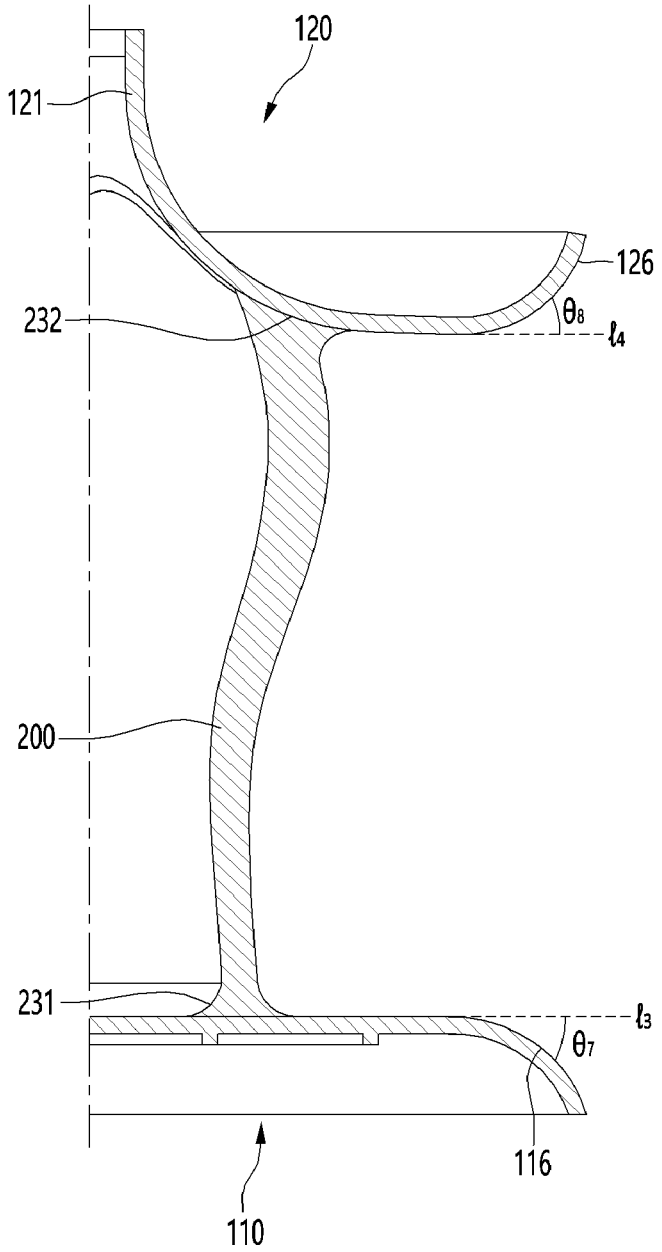
FIG. 16 is a cross-sectional view taken along line 16-16 of FIG. 1.

FIG. 16 is a cross-sectional view taken along line 16-16 of FIG. 1.

Referring to FIG. 16, the main plate 110 and the shroud 120 according to an embodiment of the present disclosure may include expansion portions 116 and 126 as "diffuser areas" for expanding the discharge passage at the radially outermost portion of the fan.

In detail, the main plate 110 may include a first extension portion 116 formed on the outer circumference of the main plate 110 and bent downward. The first extension portion 116 may have an arc shape.

The first extension portion 116 may be bent downward by a predetermined angle θ7 with respect to an imaginary line ℓ3 obtained by extending the plane of the main plate 110. For example, the predetermined angle θ7 may be in the range of 70° to 75°.

The shroud 120 may include a second extension portion 126 formed on the outer circumference of the shroud 120 and bent upward. The second extension portion 126 may have an arc shape.

The second extension portion 126 may be bent upward by a predetermined angle θ8 with respect to an imaginary line ℓ4 obtained by extending a tangent to the bottom of the shroud 120. For example, the predetermined angle θ8 may be in the range of 70° to 75°.

Due to the first and second expansion portions 116 and 126, the flow path of air discharged from the fan 10 in the radial direction may be expanded, thereby improving the positive pressure performance of the fan.

According to an embodiment of the present disclosure, a blade capable of injection molding may be provided to easily implement the three-dimensional shape of the blade.

According to an embodiment of the present disclosure, a main plate, a blade, and a shroud that constitute a centrifugal fan may be manufactured at the same time by injection molding, thereby reducing the weight of the fan and improving the operating efficiency.

According to an embodiment of the present disclosure, the performance of the fan may be improved by providing a blade that is elongated from an opening where a hub is mounted to an edge of a main plate through injection molding.

According to an embodiment of the present disclosure, injection molding of a blade may be facilitated by forming a line connecting a leading edge of the blade to the center of the fan such that the length of the line increases from a main plate to a shroud.

According to an embodiment of the present disclosure, injection molding of a blade may be facilitated by improving the curvature of the blade such that the negative pressure surface of the blade is fully visible when the blade is viewed from the suction side of the fan.

According to an embodiment of the present disclosure, the static pressure performance of the fan may be improved by forming a diffuser area capable of expanding air discharge on the outer circumference surfaces of the main plate and shroud.

According to an embodiment of the present disclosure, by improving the change in curvature at the leading edge and trailing edge of the blade, the flow velocity in the positive pressure surface may be increased and the static pressure performance may be improved.

What is claimed is:

1. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein the leading edge is formed such that a distance from a center of the main plate to the leading edge increases in a direction from the main plate towards the shroud, and wherein, when a center line extending radially from the center of the main plate and a plurality of points along the leading edge are defined, the plurality of points being arranged in the direction from the main plate to the shroud along the leading edge, a center angle formed by the center line and an extension line connecting the plurality of points and the center of the main plate becomes smaller as a distance from the extension line to the shroud decreases.

2. The centrifugal fan of claim 1, wherein each leading edge comprises a first portion connected to the main plate, and a second portion, a third portion and a fourth portion sequentially extending from the first portion towards the shroud, wherein, when a center line extending radially from the center of the main plate and first to fourth extension lines connecting the center of the main plate to the first to fourth portions, respectively, are defined, a center angle formed between the center line and the second extension line is less than an angle formed between the center line and the first extension line, and a center angle formed between the center line and the third extension line is less than the center angle formed between the center line and the second extension line.

3. The centrifugal fan of claim 1, wherein, when a plurality of points are defined along each leading edge in the direction from the main plate to the shroud, a length of an extension line connecting the plurality of points from the center of the main plate increases as a distance from the extension line to the shroud decreases.

4. The centrifugal fan of claim 3, wherein each leading edge comprises a first portion connected to the main plate, and a second portion, a third portion, and a fourth portion sequentially extending from the first portion towards the shroud, wherein, when first to fourth extension lines connecting the center of the main plate to the first to fourth portions, respectively, are defined, a length of the second extension line is longer than a length of the first extension line and a length of the third extension line is longer than the length of the second extension line.

5. The centrifugal fan of claim 1, wherein the negative pressure surface of each blade is arranged such that an entire negative pressure surface faces the inlet port of the shroud.

6. The centrifugal fan of claim 1, wherein the main plate, the shroud, and each blade are injected by a first mold having a portion implementing a shape of the main plate, a second mold having a portion implementing a shape of the shroud, and a plurality of third molds having portions implementing a shape of each blade.

7. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, wherein the first end portion comprises a protruding connection portion connected to the outer circumference of the protrusion, and wherein, when a tangent to the outer circumference of the protrusion at the protruding connection portion is defined, the tangent and the first end portion form a predetermined angle, and the first end portions of the plurality of blades extend from the protrusion at the predetermined angle.

8. The centrifugal fan of claim 7, wherein, when an axial extension line passing through the protruding connection portion is defined, each leading edge is formed such that a distance from the axial extension line to the leading edge increases in the direction from the main plate towards the shroud.

9. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, and wherein a length of a first chord from the leading edge to the trailing edge at the first end portion is shorter than a length of a second chord from the leading edge to the trailing edge at the second end portion.

10. The centrifugal fan of claim 9, wherein the main plate comprises a blade connection portion provided outside the opening and to which each blade is connected, an extension portion bent from the blade connection portion, and a boundary portion forming a boundary between the blade connection portion and the extension portion, and wherein a portion of the second end portion that meets the trailing edge is located further radially outward than the boundary portion.

11. The centrifugal fan of claim 10, wherein a first angle formed between an extension line of the first chord and the boundary portion is greater than a second angle formed between the second cord chord and the boundary portion.

12. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, and wherein the trailing edge is bent with respect to an extension line extending in the axial direction to a greater degree than the leading edge.

13. The centrifugal fan of claim 12, wherein, when a first axial extension line in contact with a first part where each leading edge meets the second end portion and a second axial extension line in contact with a second part where each trailing edge meets the second end portion are defined, an angle formed between the second extension line and the trailing edge at the second part is greater than an angle formed between the first extension line and the leading edge at the first part.

14. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, and wherein the second end portion of each blade comprises:

a first part formed convexly upward in an axial direction to connect the leading edge to the shroud, a distance between the first part and the main plate having a first height; and a second part formed concavely downward in an axial direction to connect the trailing edge to the shroud, a distance between the second part and the main plate having a second height, wherein the first height is greater than the second height.

15. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, wherein each blade further comprises a bent portion formed in a middle between the leading edge and the trailing edge and in which an extension direction of the blade is bent, and wherein each blade has a shape that is folded by the bent portion such that a direction of a first air flow from the leading edge to the bent portion is opposite to a direction of a second air flow from the bent portion to the trailing edge.

16. A centrifugal fan, comprising:

a main plate having an opening for mounting a motor;

a shroud spaced apart from the main plate and having an inlet port for sucking air in an axial direction; and a plurality of blades connected between the main plate and the shroud and arranged in a circumferential direction of the opening so as to discharge air sucked through the inlet port in a radial direction, wherein each of the plurality of blades comprise a positive pressure surface along which air flows, a negative pressure surface opposite to the positive pressure surface, a leading edge defining an upstream end in the radial direction, and a trailing edge defining a downstream end, wherein the main plate, the shroud, and the plurality of blades are integrally formed as one body through injection such that the positive pressure surface, the negative pressure surface, the leading edge and the trailing edge form a curved surface, wherein each blade comprises a first end portion connected to the main plate and a second end portion connected to the shroud, and the first end portion is connected to an outer circumference of a protrusion surrounding the opening of the main plate, wherein the main plate comprises a blade connection portion provided outside the opening and to which each blade is connected, an extension portion bent from the blade connection portion, and a boundary portion forming a boundary between the blade connection portion and the extension portion, and wherein a portion of the second end portion that meets the trailing edge is located further radially outward than the boundary portion.

* * * * *